United States Patent [19]

Sochor

[11] 4,416,504

[45] Nov. 22, 1983

[54] CONTACT WITH DUAL CANTILEVERED ARMS WITH NARROWED, COMPLIMENTARY TIP PORTIONS

[76] Inventor: Jerzy R. Sochor, 164 Rockview, Irvine, Calif. 92715

[21] Appl. No.: 355,472

[22] Filed: Mar. 8, 1982

Related U.S. Application Data

[63] Continuation of Ser. No. 92,125, Nov. 7, 1979, abandoned.

[51] Int. Cl.[3] ..... H01R 13/05

[52] U.S. Cl. ..... 339/252 P; 339/252 R

[58] Field of Search ..... 339/252 R, 252 P

[56] References Cited

U.S. PATENT DOCUMENTS

| | | | |
|---|---|---|---|
| 2,517,677 | 8/1950 | Kjell-Berger et al. | 339/252 P |
| 3,238,497 | 3/1966 | Zell et al. | 339/252 P |
| 3,581,272 | 5/1971 | Yopp et al. | 339/252 P |
| 3,717,841 | 2/1973 | Mancini | 339/252 P |
| 3,820,061 | 6/1974 | Holden | 339/252 P |
| 3,970,356 | 7/1976 | Joly | 339/252 P |
| 4,070,088 | 1/1978 | Vaden | 339/252 R |
| 4,148,547 | 4/1979 | Otsuki et al. | 339/258 R |
| 4,169,654 | 10/1979 | Plyler et al. | 339/252 P |

FOREIGN PATENT DOCUMENTS

| | | | |
|---|---|---|---|
| 1203421 | 8/1970 | United Kingdom | 339/252 P |

OTHER PUBLICATIONS

Federal Stab-Loc Catalog; 1953; pp. 14–16.

*Primary Examiner*—John McQuade
*Attorney, Agent, or Firm*—David Pressman

[57] ABSTRACT

For mating with a tubular female contact 12, a male contact 10, has two cantilevered arms (16, 18) extending from its body portion 14. The arms are each formed of sheet metal and each has a convex mating surface near its tip which faces outwardly, away from the other arm. The arms may have equal or unequal lengths, may be displaced laterally in the plane of the sheet metal, and may be shaped so that the tips either contact or are spaced when mated. In a preferred embodiment, the ends of the arms have a complementary stepped configuration 50 to reduce the volume of the contact's mating portions; the resultant narrower end portions of the arms, as well as the convex mating surfaces further down on the arms, may both mate with the female contact, providing two points of contact on each arm.

5 Claims, 23 Drawing Figures

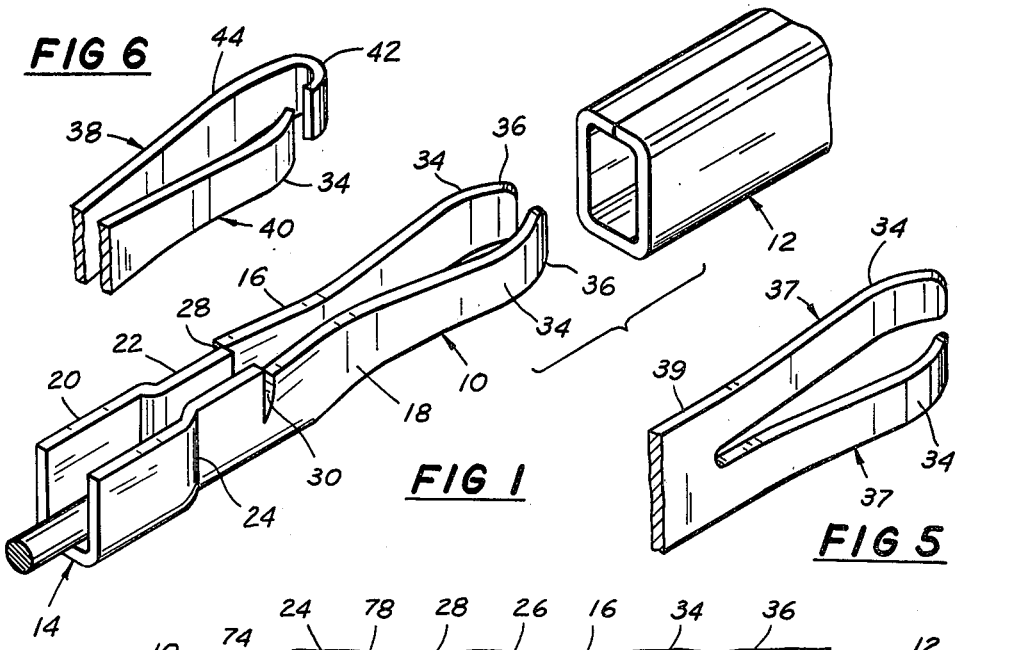
FIG 6
44
42
38
34
40
36
34
12
16
36
28
34
22
10
20
18
30
24
14
FIG 1
34
37
39
34
37
FIG 5
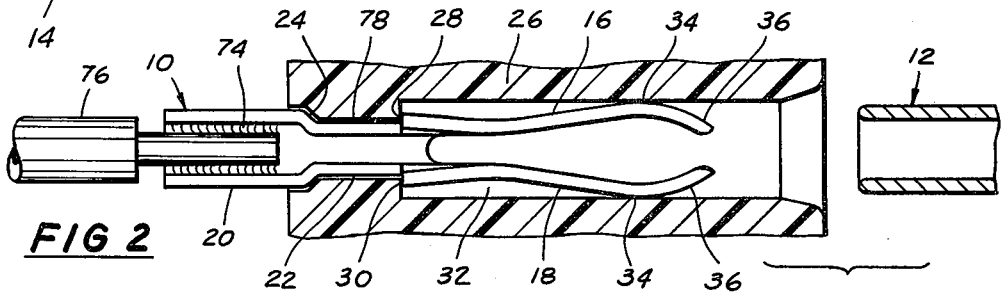
24
78
28
26
16
34
36
12
76
10
74
20
22
30
32
18
34
36
FIG 2
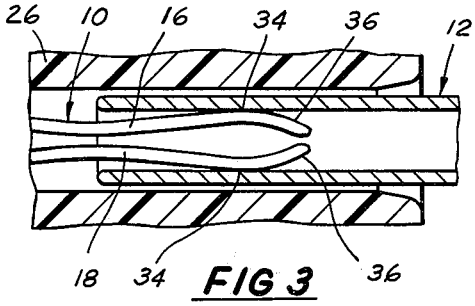
26
10
16
34
36
12
18
34
36
FIG 3
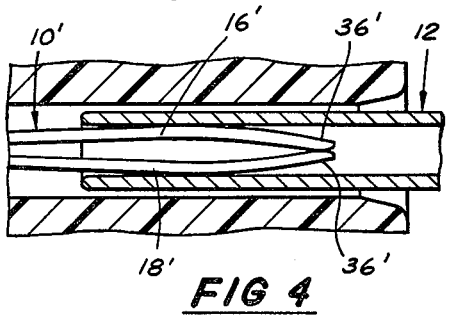
10'
16'
36'
12
18'
36'
FIG 4
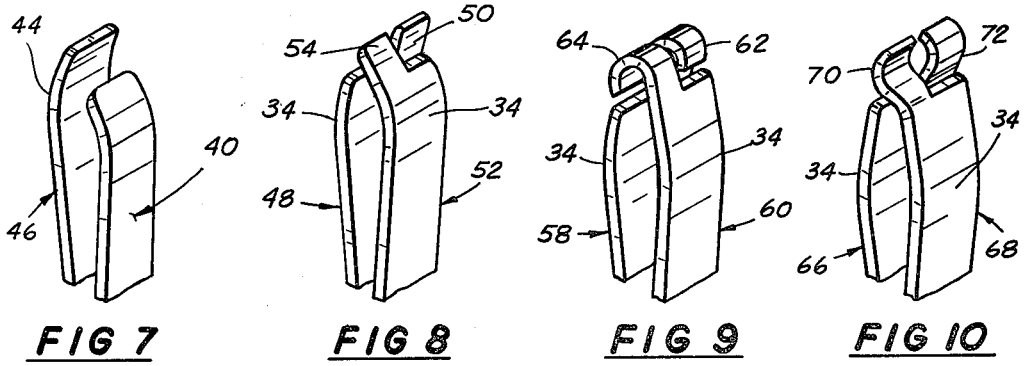
44
40
46
FIG 7
54
50
34
34
52
48
FIG 8
64
62
34
34
60
58
FIG 9
70
72
34
34
68
66
FIG 10

CONTACT WITH DUAL CANTILEVERED ARMS WITH NARROWED, COMPLIMENTARY TIP PORTIONS

This application is a continuation of prior application, Ser. No. 06/092,125, filed 1979 Nov. 07, now abandoned.

BACKGROUND

1. Field of Invention

This invention relates to electrical contacts and particularly to miniature contacts which are suitable for use in separably joining wires and electronic components when extremely small connector size is desired.

2. Description of Prior Art

Electrical connectors of the type which are designed to removably connect electronic components and wires require resilient contacts which provide pressure for reliable, low resistance connections under repeatable mating. Either one or both of each pair of mating contacts may be resilient—when both contacts are resilient they are usually hermaphroditic.

In a typical two-piece connector, comprising pin and socket mating parts, a rigid pin or male prong engages a resilient socket or female contact to provide contact pressure equal to the product of stiffness and deflection of the female's resilient member.

While rigid male/resilient female mating contacts are common, they have certain disadvantages which become clearly evident in ultra-miniature applications.

Principally, the rigidity of the male pin decreases as its size is reduced. Also contact forces cannot be controlled adequately; the small deflection range is disproportionately affected by resilient socket manufacturing tolerances and plating access requirements which are inconsistent with optimum contact spring parameters.

On the other hand, while resilient male/rigid female mating contacts are made, these generally underutilize available contact volume and have the disadvantages of lack of reliability due to inconsistent contact forces, difficulty of fabrication, high susceptability to damage and relatively high cost.

Accordingly, several objects of the present invention are to provide a resilient male contact for mating with a rigid female contact wherein the male contact has better contact spring parameters, a more rigid associated female contact, improved reliability and mechanical integrity, and is easier to fabricate than other contacts heretofore extant.

Further objects and advantages of the invention will become apparent from a consideration of the ensuing description thereof.

DRAWINGS

In the drawings, which are to approximate scale,

FIG. 1 is an isometric view of a dual cantilevered male contact and mating female contact.

FIG. 2 is a side sectional view of the male contact of FIG. 1 in an insulator with a mating female contact.

FIG. 3 is a side elevational view of the mating portion of FIG. 2 after mating.

FIG. 4 is a side sectional view similar to FIG. 3 but with the male contact having elongated arms which touch at the tips after mating.

FIG. 5 is an isometric view of a relatively planar male contact with dual cantilevered arms.

FIG. 6 is an isometric view of part of a male contact which has arms of unequal length, with the longer arm curved over and back toward the shorter arm.

FIG. 7 is an isometric view of a male cantilevered contact which has arms of unequal length.

FIG. 8 is an isometric view of a male contact having arms with a stepped, complementary lead-in configuration.

FIG. 9 is an isometric view of a male contact wherein the arms have a stepped, complementary configuration with bent tips.

FIG. 10 is an isometric view of a male contact with stepped, complementary contact arms with tips bent in a reverse curve.

Figure 11:
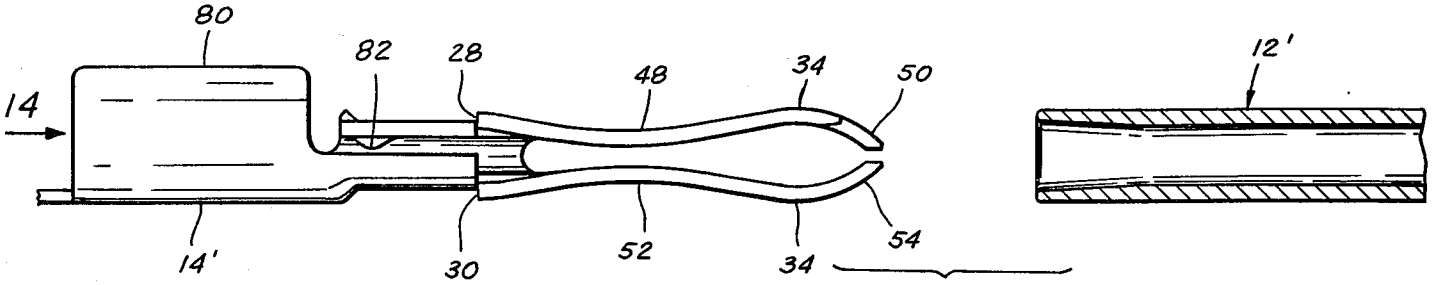
FIG. 11 is a side sectional view of a stepped male contact and part of a mating female contact.

| Reference Numerals | | |
|---|---|---|
| 10 male contact | 39 common portion | 70 curved portion |
| 12 female contact | 40 shorter arm | 72 curved portion |
| 14 body | 42 bight portion | 74 solder |
| 16 cantilevered arm | 44 mating surface | 76 wire |
| 18 cantilevered arm | 46 longer arm | 78 constricted portion |
| 20 rear portion | 48 back arm | 80 crimp tab |
| 22 forward portion | 50 narrow portion | 82 wire stop |
| 24 shoulder | 52 front arm | 84 cavity |
| 26 insulator housing | 54 narrow portion | 86 insulator |
| 28 shoulder | 56 second bend | 88 constricted portion |
| 30 shoulder | 58 back arm | 90 shoulders |
| 32 cavity | 60 front arm | 92 shoulders |
| 34 mating surface | 62 curved portion | 94 spreading tool |
| 36 tip portion | 64 curved portion | 96 annular portion |
| 37 arm | 66 back arm | |
| 38 longer arm | 68 front arm | |

FIGS. 1-3

The contact according to a first embodiment of the invention comprises a resilient male member 10 designed to mate with a generally square cross-sectioned rigid female sleeve or tube contact 12. Male contact 10 is shown in a top view in FIG. 2.

Male contact 10 may be formed of phosphor bronze or beryllium copper stock about 0.15 mm thick and may be about 0.75 mm by 1 mm in cross section and 7 mm long. It is folded to have a generally U-shaped configuration and comprises a body portion 14 having two cantilevered arms 16 and 18 extending therefrom. Body 14 has a broadly cross-sectioned rear portion 20 which constricts to a narrower (still U-shaped) forward portion 22 to provide a shoulder 24 for restraining the contact against forward movement in an insulator housing 26 (FIG. 2).

Cantilevered arms 16 and 18 extend from the sides of narrow portion 22 and are partially sheared from such sides to form shoulders 28 and 30 which lock contact 10 in cavity 32, i.e., against rearward movement in insulator 26.

Each contact arm, such as 18, flares slightly and then returns so as to form a convex mating surface 34 adjacent its tip portion 36. Tip portions 36 of contacts 16 and 18 form a converging lead-in so that male contact 10 can be smoothly and reliably inserted in the lumen of female contact 12.

In practice, and as discussed more fully below, contact 10 is mounted in insulator 26 by inserting it, tips 36 first, into the left end of insulator 26 until shoulders 28 and 30 lock the contact as illustrated in FIG. 2. When inserted, arms 16 and 18 will be squeezed closer together than in their free state so that mating surfaces 34 are preloaded, i.e., pressing against the inside walls of insulator 26. Insulator 26 is designed to enclose male contact 10 completely so as to protect the same since it is resilient and thus more susceptible to damage than rigid female contact 12. Thus arms 16 and 18 of male contact 10 are well recessed in insulator 26, and female contact 12 extends out from its insulator (not indicated in FIGS. 1 and 3).

As indicated in FIG. 3, contact arms 16 and 18 are shaped so that when they are inserted into female contact 12, they will be squeezed (deflected) even closer together by the inside surfaces of contact 12, thereby generating further contact pressure proportional to the deflection created. Arms 16 and 18 will remain free-ended cantilevers since arms 16 and 18 are shaped so that their tip portions 36 will not touch. If less contact pressure in the mated condition is desired, the total deflection can be decreased by shaping arms 16 and 18 so that mating surfaces 34 will not be preloaded against the inside walls of cavity 32 (not illustrated).

FIG. 4

If a narrower contact is needed, the embodiment of FIG. 4 can be employed. Here arms 16' and 18' are made relatively long so that they can be spaced more closely together by allowing their tips 36' to touch.

The very gradual lead-in configuration of contact of FIG. 4 assures a low ratio of peak insertion force to sliding insertion force, e.g. as low as 1.1 (a ratio of 2 is more common in existing connectors). This low ratio makes it feasible to provide a low mating force connector, and or to maximize contact normal (mated) pressure for a prescribed peak insertion force.

FIG. 5

In the embodiment of FIG. 5 the contact (only the male's mating portion is shown) has arms 37 of equal lengths which extend in a generally coplanar manner from a flat common portion 39. Common portion 39 may extend from the central section of a U-shaped body portion, such as body portion 14 in FIG. 1. Arms 37 both have a convex mating surface 34 and are bent in opposite directions such that mating surfaces 34 face outwardly in opposite directions and the tips of arms 37 form a tapered lead-in.

The contact of FIG. 5 is designed to mate with a rectangular cross-sectioned female tube (not shown). Due to its relatively flat configuration, it is especially suitable for use in compact connectors of the type where the contacts are arranged in a closely spaced relationship.

FIG. 6

In the embodiment of FIG. 6, the contact has arms 38 and 40 of unequal lengths with longer arm 38 having a bight portion 42 which curves back towards the tip of arm 40. Arms 38 and 40 have convex mating surfaces 44 and 34, respectively.

Bight portion 42 of longer arm 38 forms a lead-in for both arms. By virtue of this configuration, the shorter arm can be mounted closer to the longer arm so that the contact's cross-sectional area is smaller then that of the embodiment of FIG. 1. In addition, the tip of shorter arm 34 is protected against snagging on the edge of female contact 12 during insertion because it is shielded by the end of longer arm 38.

FIG. 7

The embodiment of FIG. 7 also has longer and shorter arms 46 and 40, respectively, but differs from that of FIG. 6 in that longer arm 46 does not have a bight portion, but merely extends beyond the tip of shorter arm 40. As in FIG. 6, mating surface 44 of the longer arm is adjacent the tip of the shorter arm. Again, by virtue of the fact that the tip of the shorter arm fits in the concavity of the inside of the longer arm, the embodiment of FIG. 7 has a smaller cross sectional area than the embodiment of FIG. 1.

FIGS. 8, 11–13, 20 AND 21

The embodiments of these figures have arms with complementary-narrowed tip portions. This enables the contacts to occupy less cross-sectional area, yet both arms can have the same dimensions. With particular reference to FIG. 8, back contact arm 48 has a narrowed extension or tip portion 50 on the right side thereof, as seen in the drawing, while front arm 52 has a narrowed extension portion 54 on the left side thereof. Narrowed tip portions 50 and 54 thus occupy complementary spaces in the tip areas of contacts 48 and 52. Thus arms 48 and 52 can overlap and thereby be spaced more closely, without touching, than can the uniform-width arms of FIG. 1. As can be best seen in FIGS. 8 to 10, the tip portion of each contact arm has a substantially uniform width in its lateral dimension (perpendicular to its flexing and mating directions); this enables such tip portions to have a separation which, when viewed in the flexing direction, is substantially parallel to the mating direction.

In their free state, narrowed tip portions 50 and 54 may overlap or be separated from each other, as shown in FIG. 11, when a larger deflection is desired. Upon mating, narrowed portions 50 and 54 overlap to occupy complementary spaces, thus significantly reducing the volume required for the connection. Since the ends of tip portions 50 and 54 are not allowed to touch the mating surfaces of the lumen of female contact 12', arms 48 and 52 operate as free-ended cantilever springs with a single mating surface 34, providing two contact areas per connection.

Figure 20:
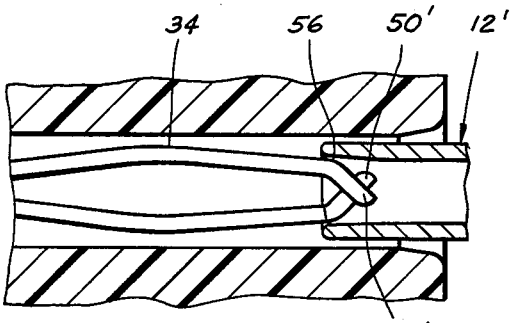
FIG. 20 is a sectional view of a contact similar to the contact of FIG. 8 about to mate and FIG. 21 shows the contact of FIG. 20 after mating.
Figure 22:
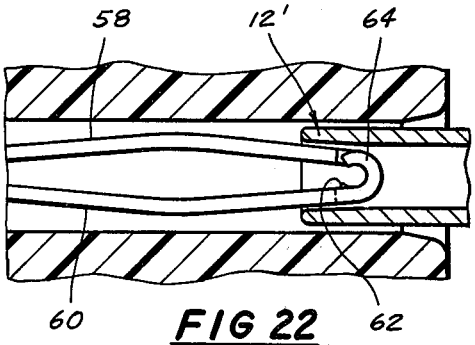
FIG. 22 is a sectional view of the contact of FIG. 9 about to mate and FIG. 23 shows such contact after mating.
Figure 21:
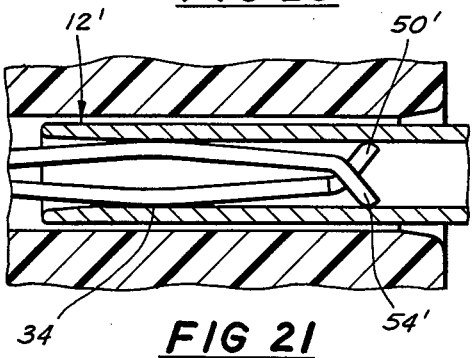

In the case of the embodiment of FIGS. 20 and 21, the tips of extension portions 50' and 54', as well as convex mating portions 34, will contact the lumen of female contact 12' when the contact is mated so that each contact arm will have two areas of contact, providing four contact areas per connection, as best indicated in FIG. 21. In this embodiment (FIG. 20) the contact arms are made substantially longer to offset the stiffening effect of support at their ends.

The shape of each contact arm can be such that the curve of convex mating portion 34 leads directly into narrowed extensions portions 50 and 54, as indicated in FIG. 8, or a second bend 56 (FIG. 20) can be provided which is spaced from convex mating portion 34 and is adjacent narrowed extension portion 54'.

As indicated in FIGS. 11, 20, and 21, as well as FIGS. 12, 13, 18, 19, 22 and 23, the wall thickness of female tube contact 12' is preferably tapered down near the tip to assure a gradual engagement and thus a low ratio of peak insertion force to sliding inserting force.

FIGS. 9, 22, AND 23

Figure 23:
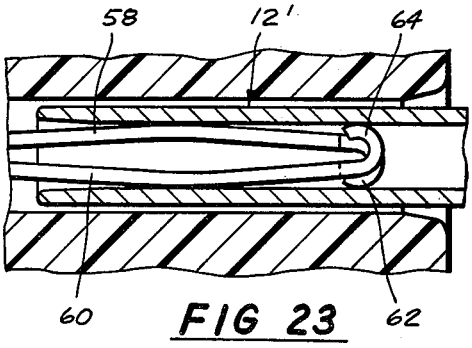

In this embodiment, arms 58 and 60 have equal lengths and have narrowed and curved extension on tip portions 62 and 64 which each contain a bight portion which curves over and back toward the opposite arm, similar to bight portion 42 in the contact of FIG. 6. This embodiment has less possibility of snagging during lead-in, since no exposed edges face the female contact. When mated, extension or tip portions 62 and 64, as well as convex mating portion 34, of each contact, will mate with female contact 12', as indicated in FIG. 23. Thus each contact arm will provide two points of contact for a more reliable connection.

FIGS. 10, 18 AND 19

Figure 19:
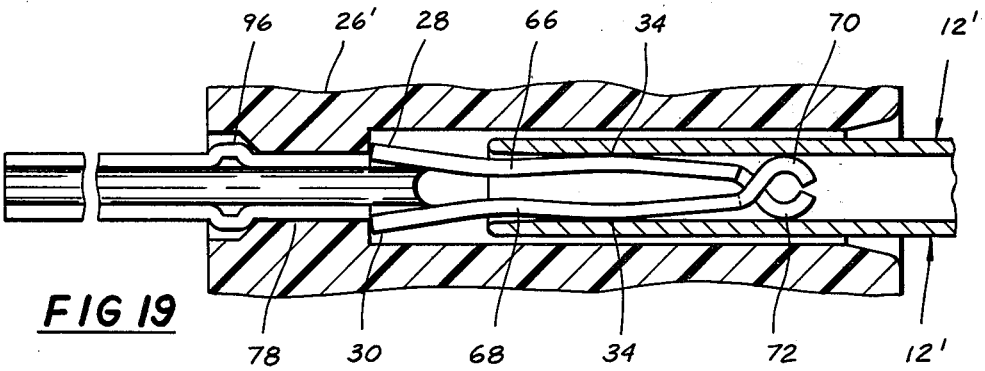
FIG. 19 is a sectional side view of the contact of FIG. 10 after mating and showing its insulator.

In this embodiment contact arms 66 and 68 are of equal length and have narrowed and curved extension or tip portions 70 and 72 which make a reverse curve from the direction of curvature of convex mating portions 34. This embodiment is easier to fabricate than the embodiment of FIG. 9, since a U-shaped forming operation is not required. When the contact is mated, both convex mating surface 34 and the convex mating surface of curved extension portions 70 and 72 will mate with female contact 12', as indicated in FIG. 19.

TERMINAL CONNECTIONS AND CONTACT RETENTION METHODS

In addition to its disconnect of front mating function, every contact must have a termination or rear connection to a wire, printed circuit board, or the like. In male contact 10 of FIG. 1, U-shaped body portion 14 is shown soldered at 74 to the stripped end of a wire 76 (FIG. 2).

Body portion 14 of contact 10 is retained in insulator housing by shoulders 24 and 28 which engage and lock the contact to a constricted portion 78 of insulator 26. As stated, contact 10 is mounted in the insulator by inserting it from the left, contact arm first, so that contact arms 16 and 18 will be completely pushed through constricted portion 78, whereafter shoulders 28 and 30 will snap back into place to lock the contact in insulator 26 around constricted portion 78 as indicated in FIGS. 2 and 12.

The contact may alternatively be crimped to wire 76 in conventional fashion if crimp tabs such as 80 (FIG. 11) are provided. In this case, wire 76 is placed in U-shaped portion 14' of the contact body and tabs 80 are crimped to the wire to provide the rear connection indicated in FIGS. 12 and 13.

In the case of small diameter wires, wire insertion can be limited by a wire stop 82 (FIGS. 11–14), which is simply a cutout tab, bend inwardly, on one or both sided of the body portion of the contact.

Figure 12:
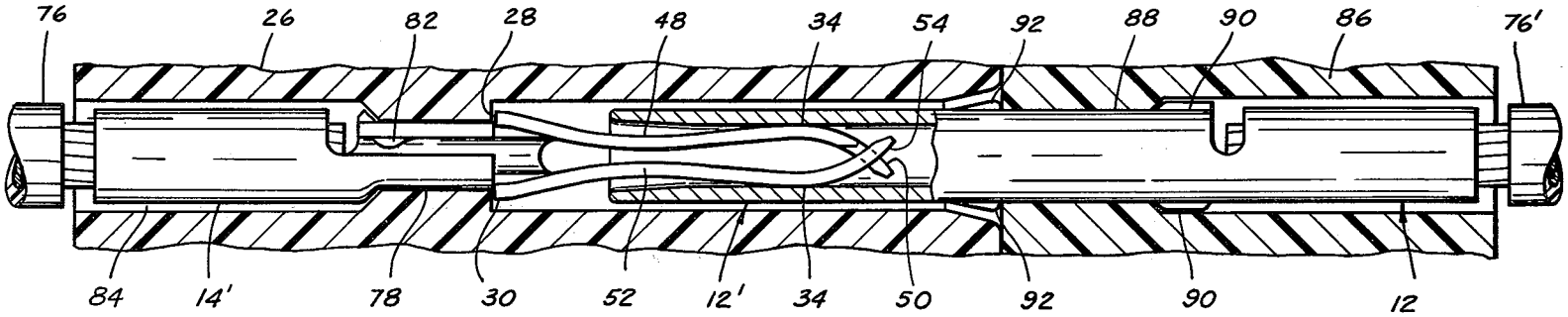
FIG. 12 is a side sectional view of the contacts of FIG. 11 with their insulators and after mating.

As indicated in FIG. 12, wire stop 82 transitions into a feature which aids in holding the contact against constricted portion 78 of insulator 26.

Figure 14:
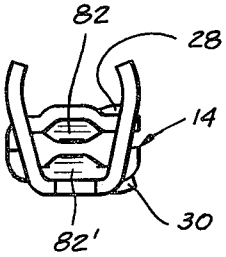
FIG. 14 is an end view of the male contact.

FIG. 14 shows a back end view of male contact 10 before it is crimped to wire 76. Note wire stops 82 and 82' and shoulders 28 and 30.

Figure 13:
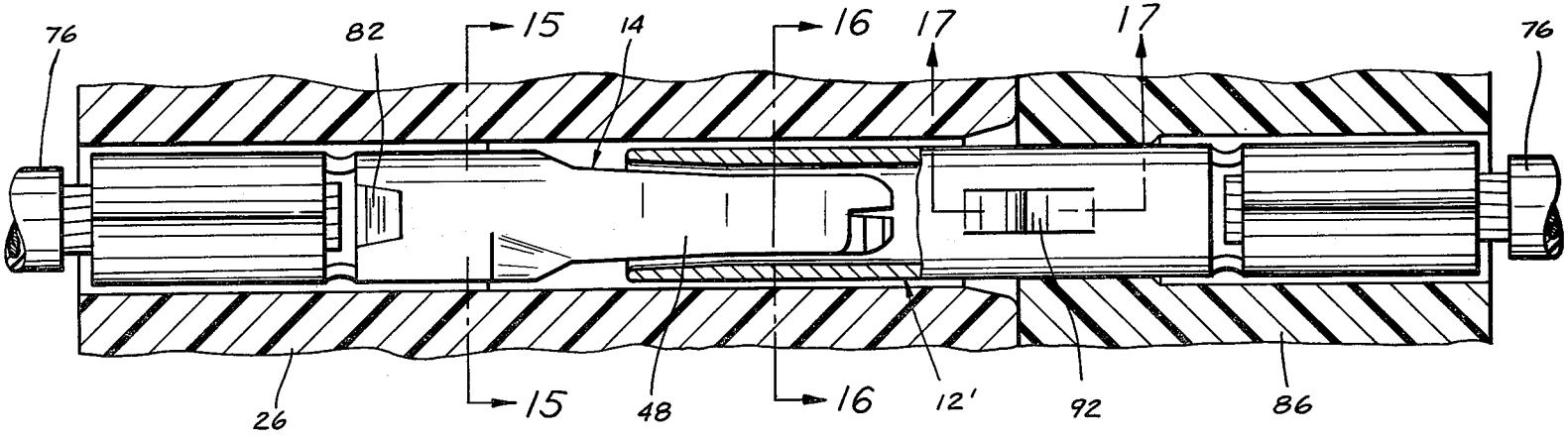
FIG. 13 is a bottom-side view of assembly of FIG. 12.
Figure 15:
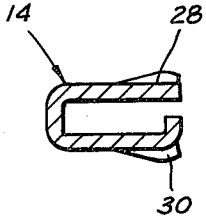
FIG. 15 is a sectional view of the male contact of FIG. 13 taken along the lines 15—15.

FIG. 15 is a cross-sectional view of contact 14 taken along the lines 15—15 of FIG. 13; note shoulders 28 and 30 which retain the contact in insulator 26.

Figure 16:
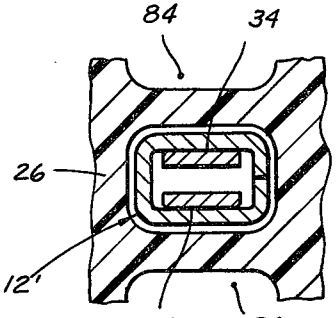
FIG. 16 is a sectional view taken along the lines 16—16 of FIG. 13.

FIG. 16 shows a cross-sectional view taken along the lines 16—16 of FIG. 13 showing female contact 12 in engagement with mating surfaces 34 of male contact 14. In practice numerous male contacts such as 14 will be mounted in straight, spiral, or concentric rows in similar cavities in insulator 26. Two such adjacent contact-holding cavities of insulator 26 are indicated at 84 in FIG. 16.

Figure 17:
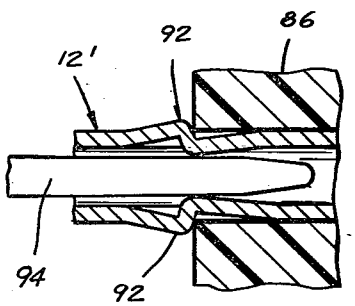
FIG. 17 is a sectional view taken along the lines 17—17 in FIG. 13 and showing a spreading tool.

Female contact 12' is held in its insulator 86 (FIGS. 12, 13, and 17) so that its rectangular mating portion (FIG. 1) protrudes, whereby such mating portion can ge inserted to insulator 26.

The barrel or rear portion of female contact 12' is crimped to a wire 76. The body portion is held to a constricted portion 88 of insulator 88 by stoppingshoulders 90 (FIG. 12) which are formed by partially punching tabs out of the body. The front of female contact 12' is held to the front of insulator 86 by retention shoulders 92 (FIGS. 12, 13, and 17) which are each formed by making two parallel shear lines and then forming the tap to have two sharp bends or offsets so as to form shoulders 92 as indicated. Upon insertion, shoulders 92 will compress and snap back to lock contact 12' as indicated best in FIG. 17. However, an even more secure retention can be obtained by spreading shoulders 92 even further out by use of a spreading tool 94. To withdraw contact 12', shoulders 92 can be compressed enough to withdraw the contact from insulator 84.

Figure 18:
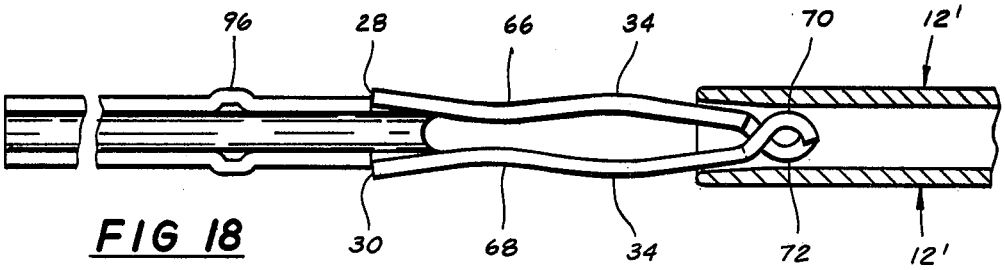
FIG. 18 is a sectional side view of the contact of FIG. 10 at the commencement of mating.

The contact of FIG. 10 is shown with a slightly different retention arrangement in FIGS. 18 and 19. Its front is held by previously discussed shoulders 28 and 30 and its rear is stopped by a annular portion 96. When the contact is inserted in insulator 26', widened portion 96 will abut against the left side of constricted portion 78 and shoulders 28 and 30 will snap out to lock against the right side thereof, whereby the contact will be securely retained. As will be apparent, the various locking features shown can be interchanged in the various contact embodiments.

While the above description contains many specificities, these should not be construed as limitations on the scope of the invention since those skilled in the art will envision other ramifications. For example, mating portions 34 which are seen flat in FIG. 16 could be curved to provide a single point of contact (rather than line contact shown) and the cantilevered arms can be adapted for use with socket sleeves with non-rectangular lumens (e.g. "U" shaped, oval or circular). Alternative retention mechanisms can be employed and a wide range of terminations are possible, including solder tails, cantilevered tabs or insulation displacement terminals. The true scope of the invention thus should be determined only by the appended claims and their legal equivalents.

I claim:

1. An electrical contact comprising:

a body portion, a pair of freestanding elongated cantilevered contact arms extending from said body portion in a first and mating direction, the end portion of each of said contact arms remote from said body portion having a convex mating surface facing away from the other contact arm in a second and flexing direction which is perpendicular to said first and mating direction, each of said contact arms comprising a bent sheet metal member whose width, as measured in a third and lateral direction perpendicular to said first and second directions, is substantially greater than its thickness, as measured generally in said second and flexing direction, each of said contact arms being flat when traversed in said third and lateral direction on either surface thereof at any location therealong, said contact arms each having a tip portion, at the free end thereof, that is narrower, in said third and lateral direction, than the rest of said contact arm, the tip portion of one arm being on the left side thereof and the tip portion of the other arm being on the right side thereof, when said contact arms are viewed in said second and flexing direction, so that said tip portions occupy complementary spaces in the width diemension of said contact when viewed in said second and flexing direction, the tip portion of each contact having a substantially uniform width in said third and lateral direction, said tip portions having a separation which, when viewed in said second and flexing direction, is substantially parallel to said first and mating direction, said contact arms also curving toward and overlapping each other at the tip portions thereof, when viewed is said third and lateral direction.

2. The contact of claim 1 wherein said narrowed tip portions each have a bight portion, such that each tip portion curves back toward and faces the other contact arm and said body portion.

3. The contact of claim 1 wherein said narrowed tip portions each have a reverse curve, such that the end of each narrowed tip portion faces outwardly and generally away from the arm of the other contact arm.

4. The contact of claim 1 wherein said contact arms are spaced and shaped such that, when mated with a tubular female contact having a lumen of predetermined dimensions, said convex mating surface and said tip portion of each contact arm will both mate with said female contact, thereby to provide two points of contact between each contact arm and said female contact.

5. The contact of claim 2 wherein said contact arms are spaced and shaped such that, when mated with a tubular female contact having a lumen of predetermined dimensions, the convex mating surface and tip portion of each contact arm will both mate with said female contact, thereby to provide two points of contact between each contact arm and said female contact.

* * * * *